US011549519B1

(12) United States Patent
Wang et al.

(10) Patent No.: US 11,549,519 B1
(45) Date of Patent: Jan. 10, 2023

(54) FAN BLADE DEVICE

(71) Applicant: Yen Sun Technology Corp., Kaohsiung (TW)

(72) Inventors: Chang-Sung Wang, Kaohsiung (TW); Mei-Chih Fang, Kaohsiung (TW)

(73) Assignee: YEN SUN TECHNOLOGY CORP., Kaohsiung (TW)

( * ) Notice: Subject to any disclaimer, the term of this patent is extended or adjusted under 35 U.S.C. 154(b) by 0 days.

(21) Appl. No.: 17/677,103

(22) Filed: Feb. 22, 2022

(30) Foreign Application Priority Data

Jul. 26, 2021 (TW) ..... 110127346

(51) Int. Cl.
*F04D 29/32* (2006.01)
*F04D 29/38* (2006.01)

(52) U.S. Cl.
CPC ..... *F04D 29/325* (2013.01); *F04D 29/326* (2013.01); *F04D 29/329* (2013.01); *F04D 29/386* (2013.01); *F04D 29/388* (2013.01)

(58) Field of Classification Search
CPC .... F04D 19/002; F04D 29/325; F04D 29/326; F04D 29/329; F04D 29/386; F04D 29/388
See application file for complete search history.

(56) References Cited

U.S. PATENT DOCUMENTS

| | | | | |
|---|---|---|---|---|
| 5,611,668 | A * | 3/1997 | Yapp | F04D 29/326 416/189 |
| 6,318,964 | B1 * | 11/2001 | Yang | F04D 29/325 416/185 |
| 6,779,992 | B2 * | 8/2004 | Lei | F04D 29/38 416/212 R |
| 7,182,572 | B2 * | 2/2007 | Yang | F04D 29/329 415/203 |
| 10,202,981 | B2 * | 2/2019 | Lin | F04D 17/025 |
| 11,268,535 | B2 * | 3/2022 | Lin | F04D 29/624 |
| 2004/0219022 | A1 * | 11/2004 | Yang | F04D 29/388 416/186 R |

* cited by examiner

*Primary Examiner* — Christopher R Legendre
(74) *Attorney, Agent, or Firm* — Muncy, Geissler, Olds & Lowe, P.C.

(57) ABSTRACT

A fan blade device includes a plurality of main fan blades and extension fan blades. Each main fan blade includes a main fan blade body arranged obliquely, a plurality of first protrusions, and at least one engaging groove. Each extension fan blade includes an extension fan blade body arranged obliquely and having a top surface that is contiguously flush with a top surface of the main fan blade body of a respective main fan blade, a plurality of second protrusions respectively abutting against the first protrusions of the respective main fan blade, and at least one engaging piece engaging the at least one engaging groove of the respective main fan blade.

9 Claims, 9 Drawing Sheets

FAN BLADE DEVICE

CROSS-REFERENCE TO RELATED APPLICATION

This application claims priority of Taiwanese Patent Application No. 110127346, filed on Jul. 26, 2021.

FIELD

The disclosure relates to a fan blade device, more particularly to a two-halves combination type of fan blade device.

BACKGROUND

Referring to FIG. 1, a conventional fan blade device generally includes a central hub 11 and a plurality of fan blades 12 radiating outward from the central hub 11. The conventional fan blade device is typically integrally formed to reduce cost and manufacturing difficulty. With the functional evolution of various electronic products and machinery, the demand for improved heat dissipation efficiency of fan blade devices is also growing. For the aforesaid conventional fan blade device, the most direct way to improve heat dissipation efficiency is to increase the number of the fan blades 12, thereby increasing the volume of air that can be moved by the fan blades 12. The fan blades 12 of the conventional fan blade device are often arranged in the manner shown in FIG. 1; that is, they are placed around the central hub 11 at an angular interval. Therefore, the central hub 11 is made larger to increase the outer diameter thereof for installation of more fan blades 12. This is however not conducive to the miniaturization of the fan blade device.

Because of the above, there is an arrangement where the density of fan blades are increased by provisioning blades to be oblique and more adjacent to each other. In particular, each fan blade is positioned with the top portion thereof being placed over a bottom portion of an adjacent fan blade at one side, and with the bottom portion thereof being placed under a top portion of another adjacent fan blade at an opposite side, i.e., the projections of any two adjacent fan blades on an imaginary plane which is normal to the rotary axis of the fan blade device partially overlap. Although this configuration can significantly increase the number of fan blades, it will cause difficulty in demolding during manufacturing; therefore, the fan blade device of this type is not suitable for being molded integrally as one piece. Referring to FIG. 2, a typical current design of such a fan blade device is configured in two-halves. This fan blade device includes an upper hub 13, a lower hub 14 under the upper hub 13, a plurality of upper blades 15 extending radially outward from the upper hub 13, and a plurality of lower blades 16 extending radially outward from the lower hub 14. The upper hub 13 has a projection 131 that projects downward, and the lower hub 14 has an engaging groove 141 that faces upward and that is engaged with the projection 131. The upper blades 15 and the lower blades 16 are arranged alternately around the combined upper hub 13 and lower hub 14.

The design mentioned offers a manufacturing solution that is easier to demold. However, it only relies on the engagement between the projection 131 and the engaging groove 141 for positioning the upper hub 13 relative to the lower hub 14, and the upper blades 15 and the lower blades 16 are not interconnected. Therefore, the upper hub 13 and the lower hub 14 may become separated from each other during rotation, and the upper blades 15 and the lower blades 16 may consequently not be regularly arranged, thereby causing turbulence in the airflow and generating excessive noise. In addition, the larger volume of air which comes from the increase of blades will also cause more turbulence that impinges on the fan frame and generate noise.

SUMMARY

Therefore, the object of the disclosure is to provide a fan blade device that has enhanced strengthening against separation, and that can suppress noise.

According to the disclosure, a fan blade device includes an upper hub member, a lower hub member, a plurality of main fan blades, and a plurality of extension fan blades. The upper hub members has an outer surrounding surface surrounding an axis that extends in an axial direction. The lower hub member is coupled to and disposed under the upper hub member, and has an external surrounding surface that surrounds the axis. The main fan blades extend outward from the outer surrounding surface of the upper hub member. Each main fan blade includes a main fan blade body that is arranged obliquely with respect to the axis, a plurality of first protrusions that protrude from the main fan blade body, and at least one engaging groove that is recessed in a bottom surface of the main fan blade body. The extension fan blades extend outward from the external surrounding surface of the lower hub member and respectively abut against the main fan blades. Each extension fan blade includes an extension fan blade body that is arranged obliquely with respect to the axis and that has a top surface being contiguously flush with a top surface of the main fan blade body of a respective one of the main fan blades, a plurality of second protrusions that protrude from the extension fan blade body and that respectively abut against the first protrusions of the respective one of the main fan blades, and at least one engaging piece that protrudes upward from the extension fan blade body and that engages the at least one engaging groove of the respective one of the main fan blades.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
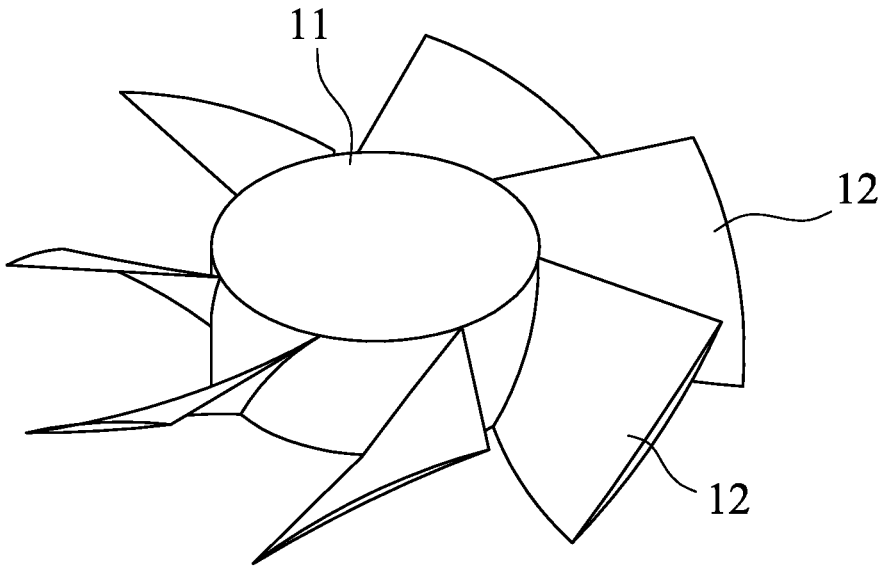
FIG.1 PRIOR ART
FIG. 1 is a perspective view illustrating a conventional fan blade device.
Figure 2:
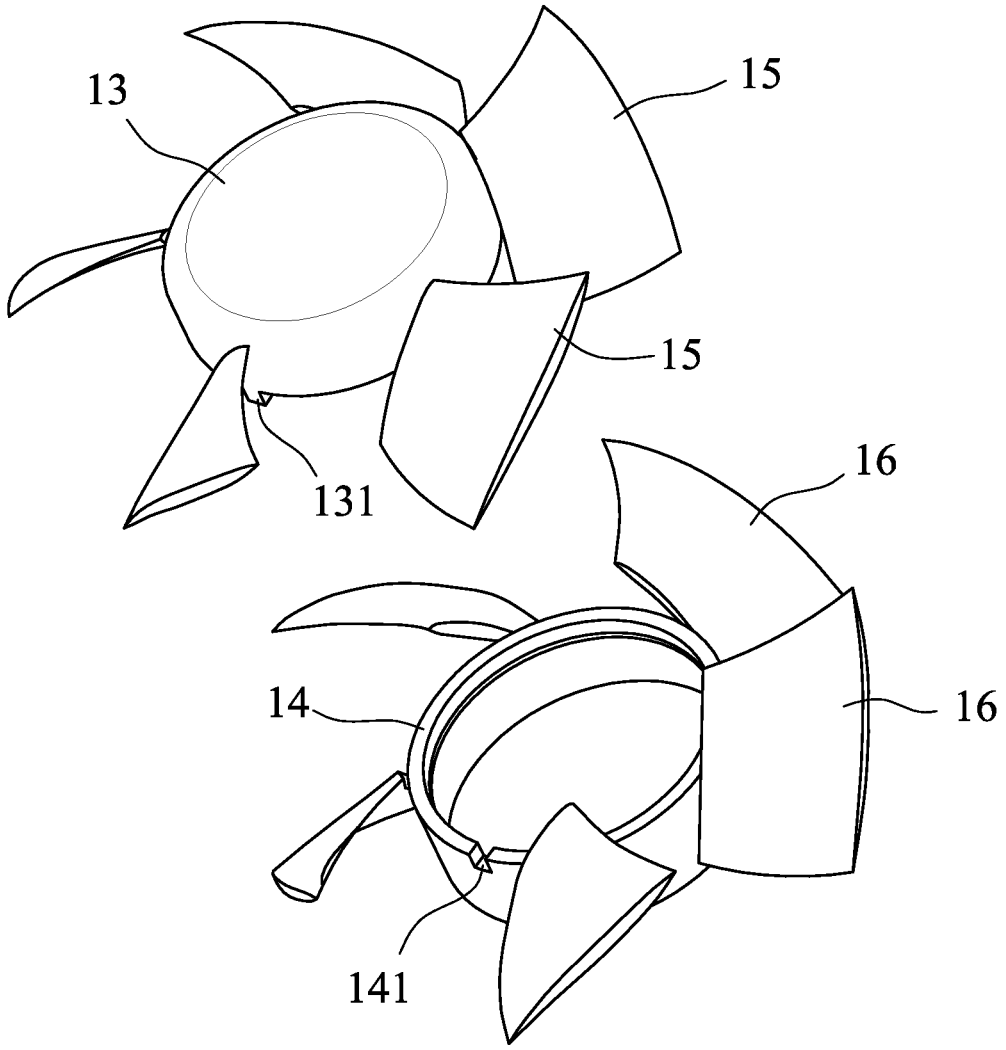
FIG.2 PRIOR ART
FIG. 2 is an exploded perspective view illustrating a conventional two-halves combination type fan blade device.

Before the present invention is described in greater detail, it should be noted that where considered appropriate, reference numerals or terminal portions of reference numerals have been repeated among the figures to indicate corresponding or analogous elements, which may optionally have similar characteristics.

Figure 3:
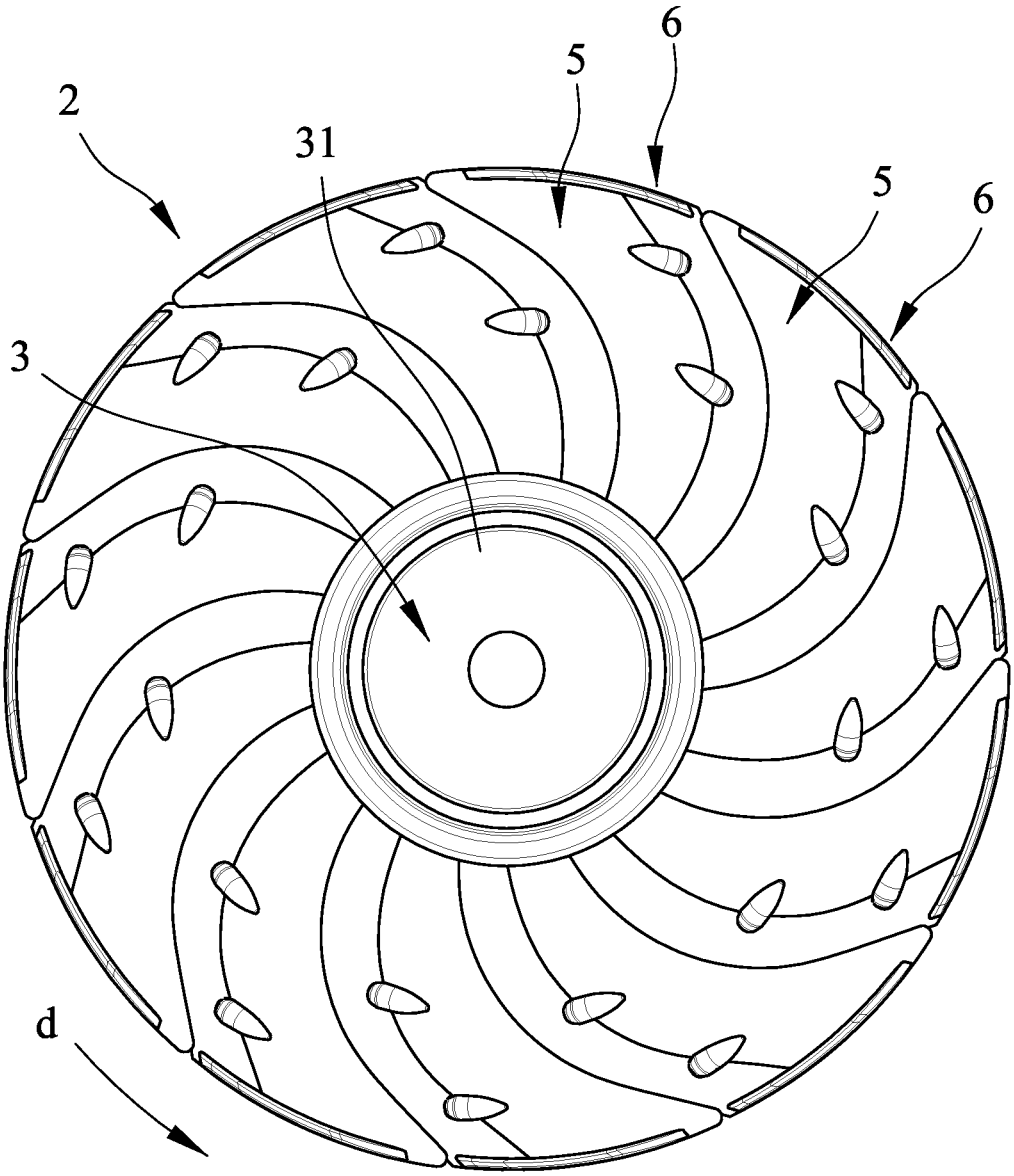
FIG. 3 is a top view illustrating a first embodiment of a fan blade device of the present disclosure.
Figure 4:
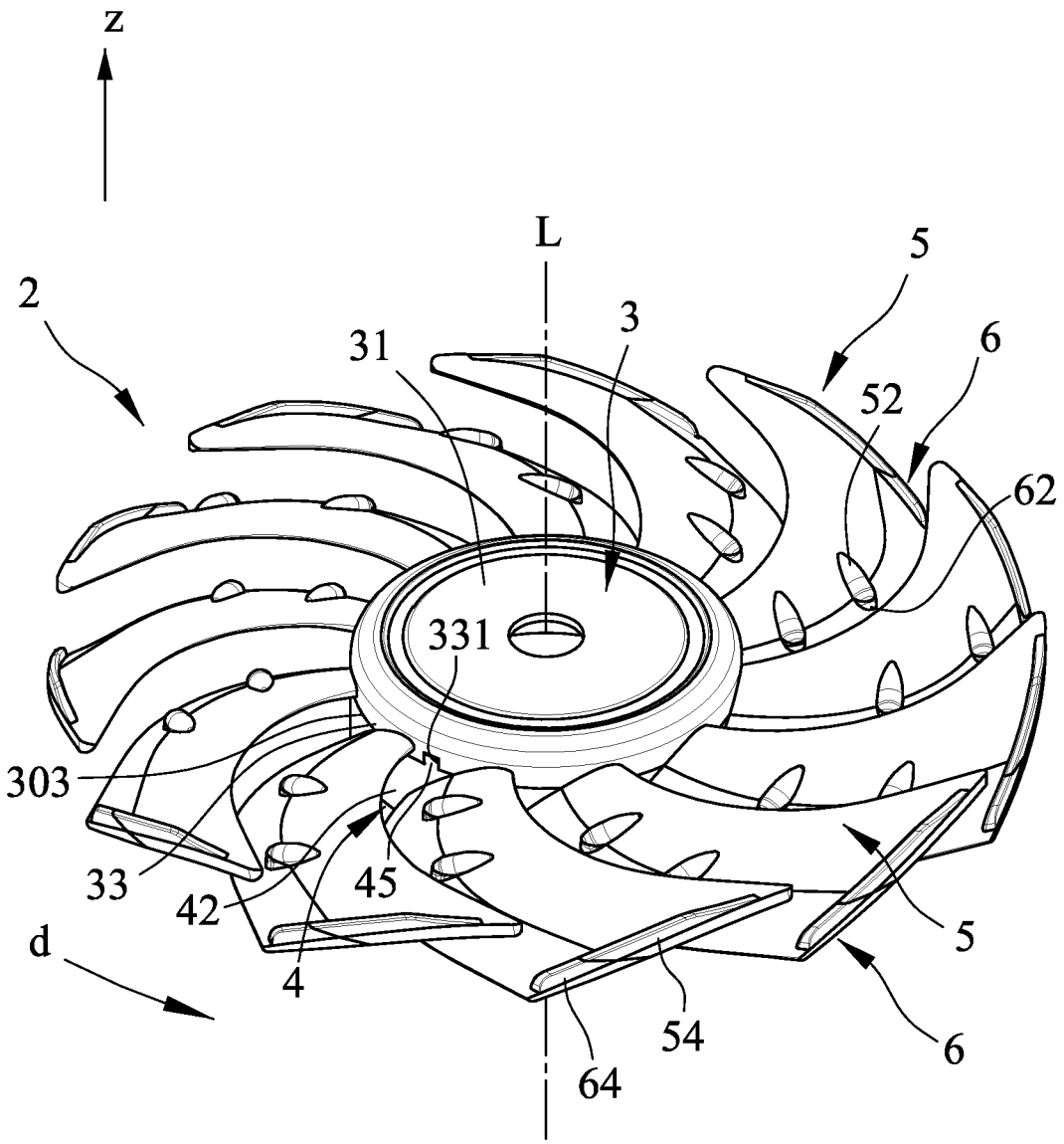
FIG. 4 is a perspective view of the first embodiment.
Figure 5:
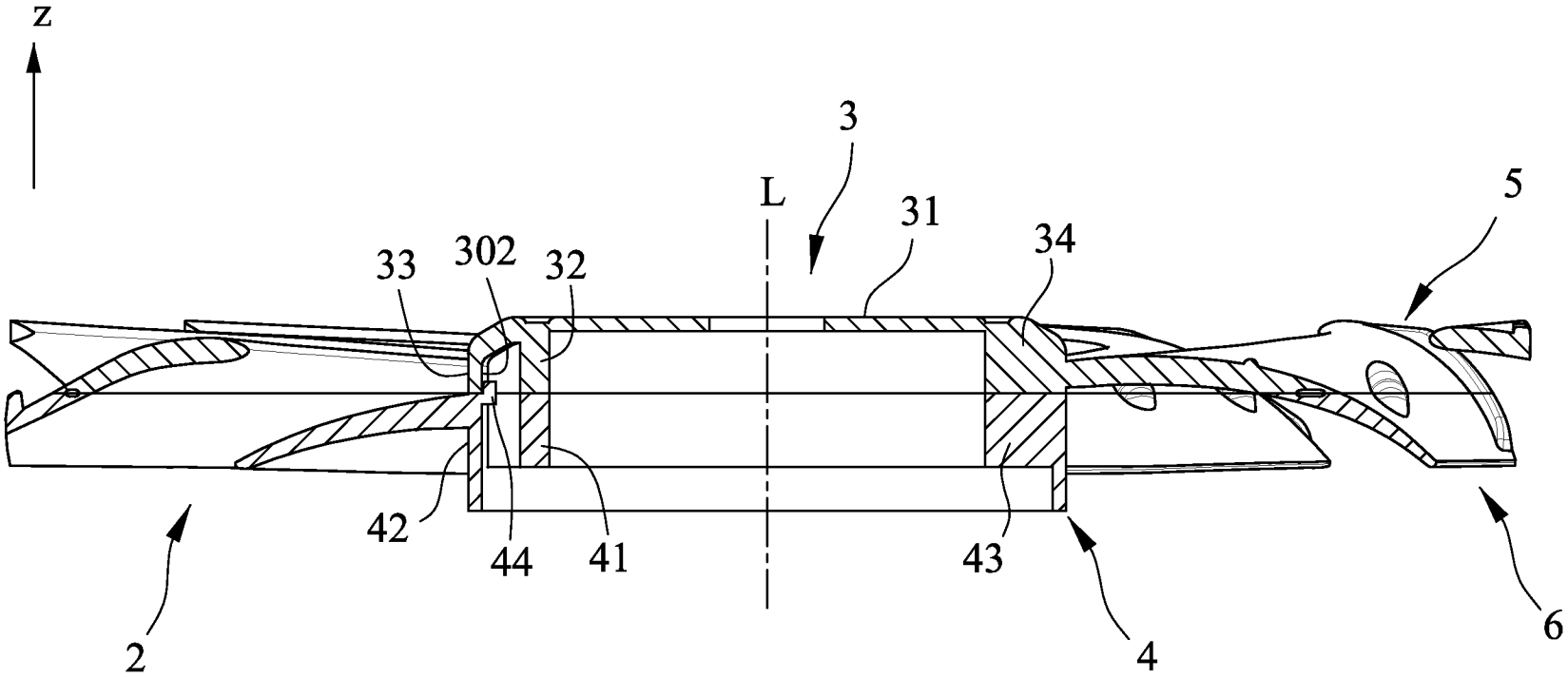
FIG. 5 is a cross-sectional view of the first embodiment illustrated in FIG. 3.

As shown in FIGS. 3, 4, and 5, a first embodiment of the fan blade device 2 according to the present disclosure includes an upper hub member 3, a lower hub member 4 coupled to and disposed under the upper hub member 3, a plurality of main fan blades 5, and a plurality of extension fan blades 6.

Figure 6:
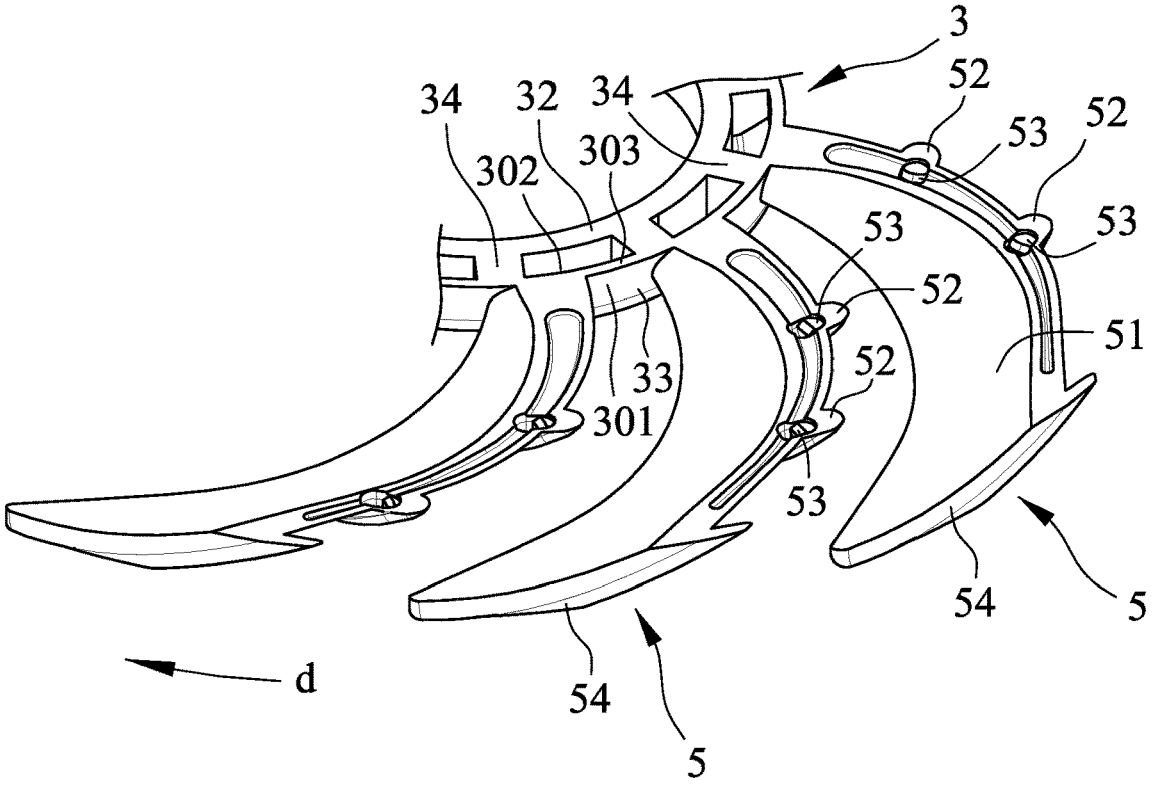
FIG. 6 is a fragmentary perspective view illustrating an upper hub member and a plurality of main fan blades of the first embodiment in an upside-down position.
Figure 7:
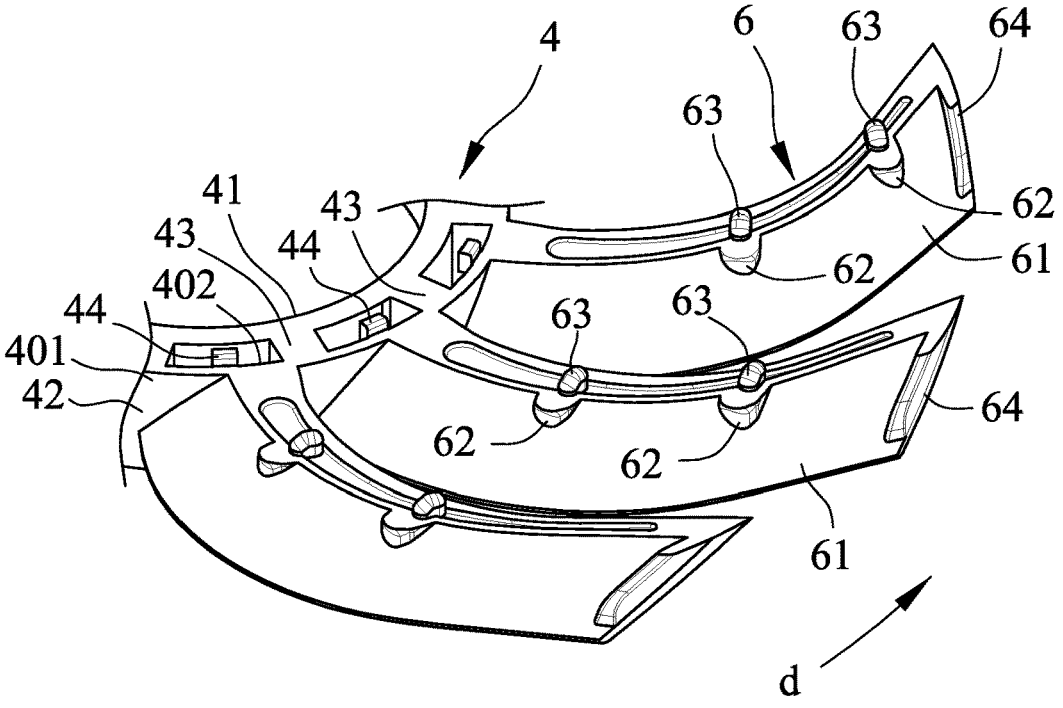
FIG. 7 is a fragmentary perspective view illustrating a lower hub and a plurality of extension fan blades of the first embodiment.

Referring further to FIGS. 6 and 7, where the upper hub member 3 and the main fan blades 5 are illustrated with an upside-down position in FIG. 6. The upper hub member 3 includes a top wall 31, an upper inner annular wall 32 extending downward from a bottom surface of the top wall 31, and an upper outer annular wall 33 extending downward from the bottom surface of the top wall 31, and surrounding and being spaced apart from the upper inner annular wall 32. The upper outer annular wall 33 has an outer surrounding surface 301 surrounding an axis (L) that extends in an axial direction (z), an inner surrounding surface 302 opposite to the outer surrounding surface 301 and surrounding the axis (L), and a bottom surface 303 in contact with the lower hub member 4. In this embodiment, the upper outer annular wall 33 further has an indentation 331 formed in the bottom surface 303. The upper hub member 3 further includes a plurality of upper strengthening ribs 34 angularly spaced apart from each other, extending radially, and interconnecting the upper inner annular wall 32 and the upper outer annular wall 33.

The lower hub member 4 includes a lower inner annular wall 41 disposed under and abutting against the upper inner annular wall 32 of the upper hub member 3, and a lower outer annular wall 42 surrounding the lower inner annular wall 41, and disposed under and abutting against the bottom surface 303 of the upper outer annular wall 33 of the upper hub member 3. The lower outer annular wall 42 has an external surrounding surface 401 surrounding the axis (L), and an internal surrounding surface 402 opposite to the external surrounding surface 401 and surrounding the axis (L). The lower hub member 4 further includes a plurality of lower strengthening ribs 43 that are angularly spaced apart from each other, that extend radially, and that interconnect the lower inner annular wall 41 and the lower outer annular wall 42, and a plurality of positioning pieces 44 that extend upward from the internal surrounding surface 402 of the lower outer annular wall 42 into the upper hub member 3 between the upper outer annular wall 33 and the upper inner annular wall 32. In this embodiment, the lower hub member 4 further includes a positioning block 45 (see FIG. 4) protruding upward from the lower outer annular wall 42 and engaging the indentation 331. The lower strengthening ribs 43 are disposed respectively under and abut respectively against the upper strengthening ribs 34. The positioning pieces 44 engage the inner surrounding surface 302 of the upper outer annular wall 33 of the upper hub member 3, thereby restricting the upper hub member 3 from moving relative to the lower hub member 4 in directions perpendicular to the axis (L). The engagement between the positioning block 45 and the indentation 331 prevents the upper hub member 3 from rotating about the axis (L) relative to the lower hub member 4. It should be particularly noted that, although in the first embodiment, the positioning pieces 44 and the positioning block 45 are provided on the lower outer annular wall 42, and the indentation 331 is formed in the upper outer annular wall 33, the locations of the positioning pieces 44 and the positioning block 45 may be interchanged in other embodiments.

Referring to FIGS. 4, 6, and 7, the main fan blades 5 extend outward from the outer surrounding surface 301 of the upper outer annular wall 33 of the upper hub member 3. In this embodiment, each main fan blade 5 includes a main fan blade body 51 arranged obliquely with respect to the axis (L), two first protrusions 52 protruding from the main fan blade body 51, two engaging grooves 53 recessed in a bottom surface of the main fan blade body 51, and a first raised edge section 54 protruding upward from a top surface of the main fan blade body 51 and extending in a circumferential direction (d). The extension fan blades 6 extend outward from the external surrounding surface 401 of the lower outer annular wall 42 of the lower hub member 4, and respectively abut against the main fan blades 5. In this embodiment, each extension fan blade 6 includes an extension fan blade body 61 arranged obliquely with respect to the axis (L) and having a top surface that is contiguously flush with the top surface of the main fan blade body 51 of a respective one of the main fan blades 5. Each extension fan blade 6 further includes two second protrusions 62 protruding from the extension fan blade body 61 and respectively abutting against the first protrusions 52 of the respective one of the main fan blades 5, two engaging pieces 63 protruding upward from the extension fan blade body 61 and respectively engaging the two engaging grooves 53 of the respective one of the main fan blades 5. Each extension fan blade 6 further includes a second raised edge section 64 protruding upward from the top surface of the extension fan blade body 61, extending in the circumferential direction (d), and is contiguously flush with the first raised edge section 54 of the respective one of the main fan blades 5.

Under the oblique arrangement of the main fan blades 51 and the extension fan blades 61, a projection of each main fan blade 5 in the axial direction (z) partially overlaps that of an adjacent extension fan blades 6, thereby allowing the number of the main fan blades 5 and the extension fan blades 6 installed on the upper and lower hub members 3, 4 to be increased, that is, the installation density of the fan blades can be increased through the oblique arrangement. Moreover, the engagement between the engaging pieces 63 of the extension fan blades 6 and the corresponding engaging grooves 53 of the main fan blades 5 may be configured as an interference fit. It should be particularly noted that, in other embodiments, the engaging pieces 63 may protrude downward from the main fan blade bodies 51, and the engaging groove 53 may be formed in the extension fan blade bodies 61 (i.e., the locations of the engaging pieces 63 and the engaging grooves 53 may be interchanged).

Figure 8:
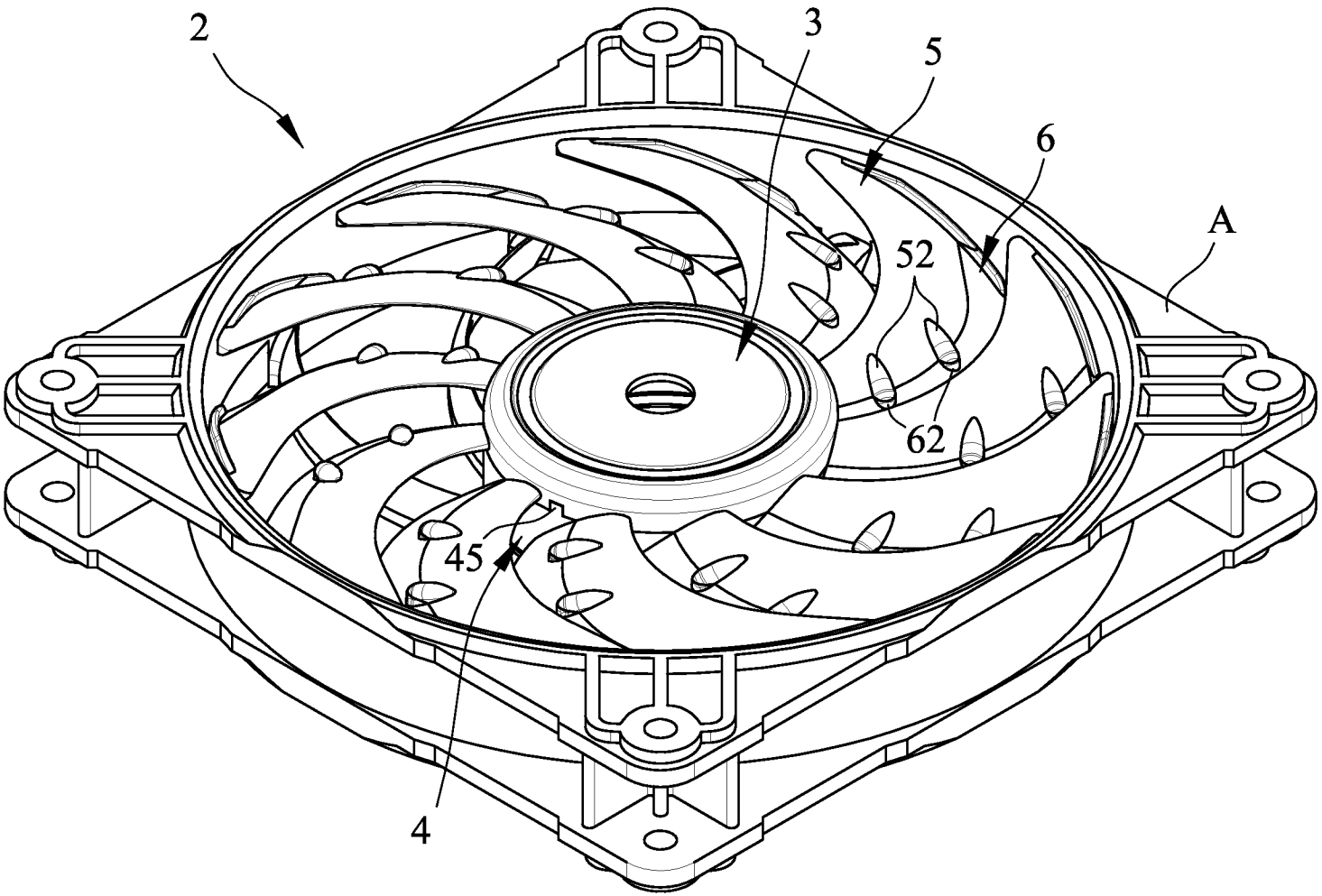
FIG. 8 is a perspective view illustrating the first embodiment mounted to a base frame.

Referring to FIGS. 6, 7, and 8, the first embodiment can be mounted to a base frame (A). Through the combination of the main fan blades 5 and the extension fan blades 6, accidental separation of the main fan blades 5 from the extension fan blades 6 during operation can be avoided, and turbulent flow and noise can consequently be decreased. The positioning pieces 44 and the positioning block 45 are used to prevent deviation of the upper hub member 3 relative to the lower hub member 4. Therefore, the length of the positioning pieces 44 and the positioning block 45 in the axial direction (z) can be made as short as possible. This in turn allows the upper hub member 3 and the lower hub member 4 to be structurally thinner in the axial direction (z). Lastly, the bulges on the main fan blade bodies 51 and the extension fan blade bodies 61 formed by the first protrusions 52 and the second protrusions 62 can reduce the airflow turbulence generated during operation, thereby further reducing the noise generated by the turbulence.

It should be noted that, in the first embodiment, each first protrusion 52 and the corresponding second protrusion 62 are only in abutment and contact. However, in other embodiments, a tongue-and-groove configuration may be applied between the two. In this way, the connection strength of each main fan blade 5 and the corresponding extension fan blade 6 is further enhanced.

Figure 9:
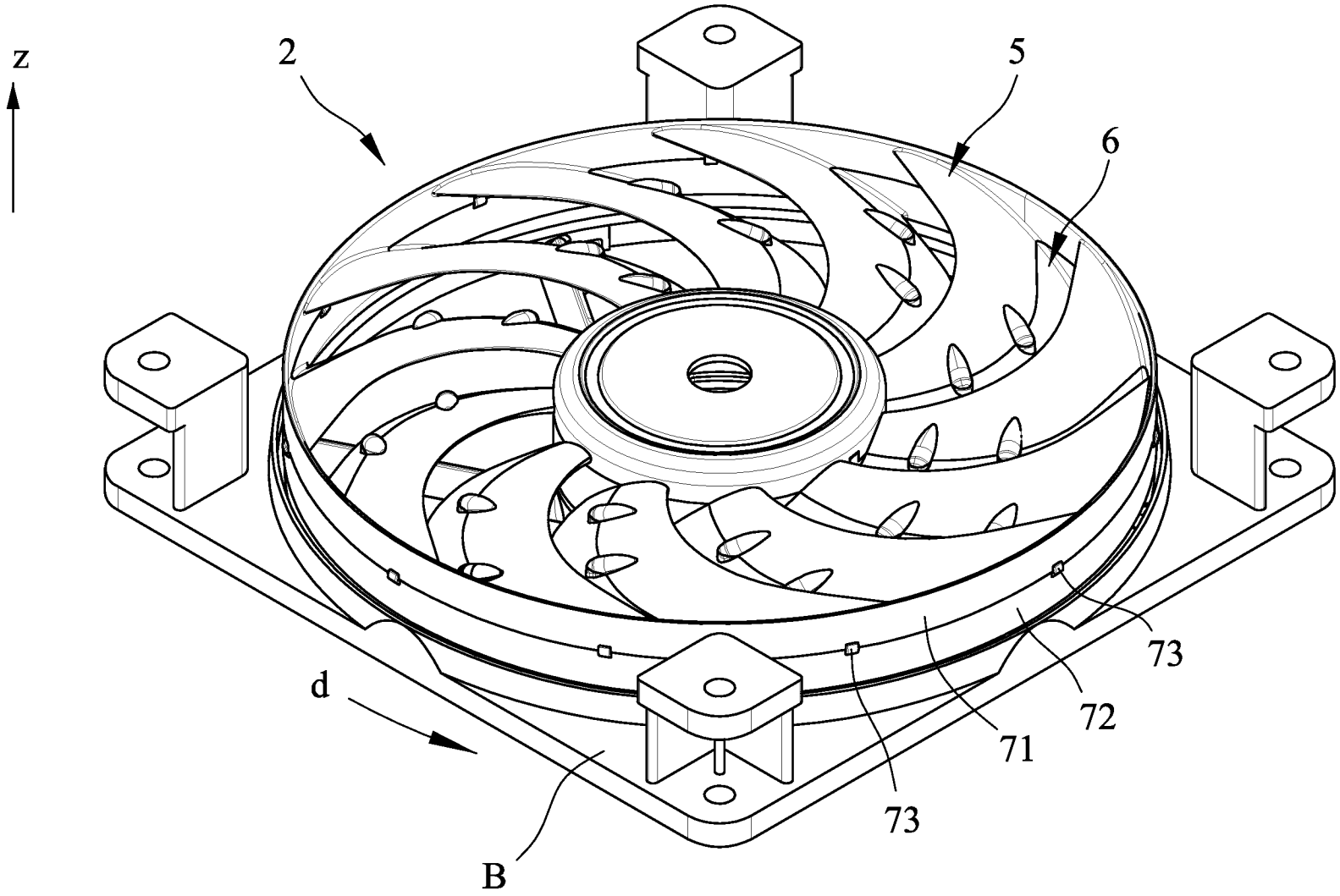
FIG. 9 is a perspective view illustrating a second embodiment of the fan blade device of the present disclosure mounted to a base frame.
Figure 10:
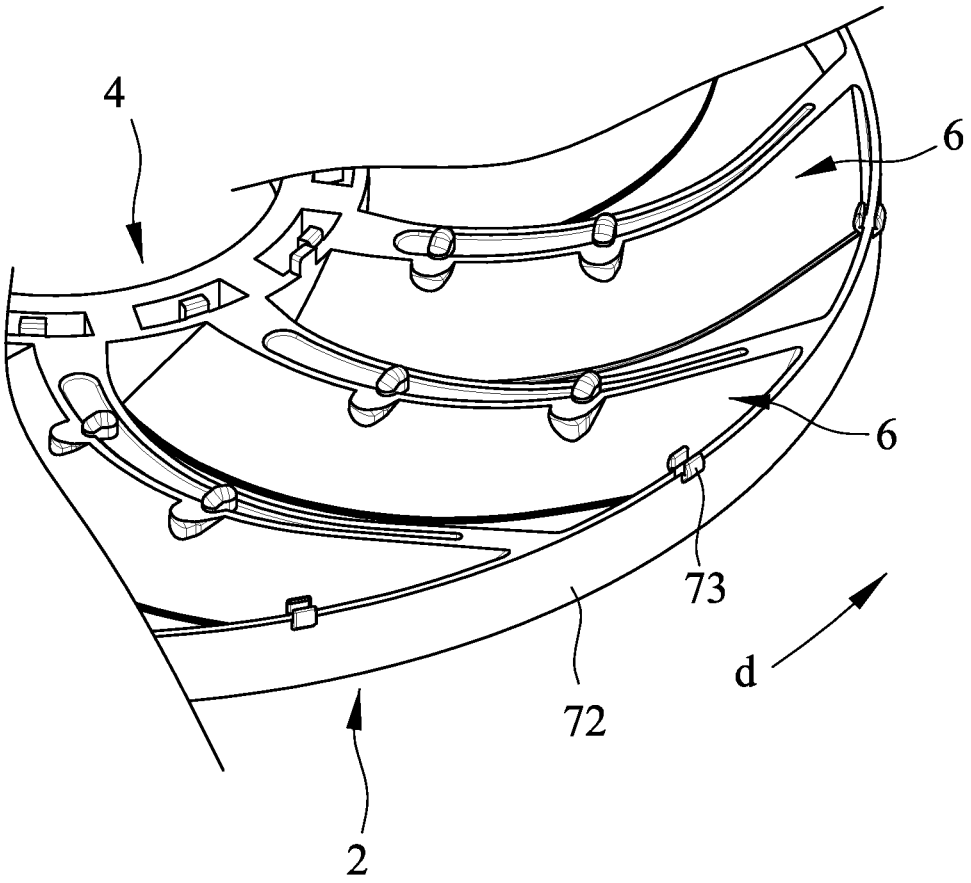
FIG. 10 is a fragmentary perspective view of the second embodiment.

Referring to FIGS. 9 and 10, a second embodiment of the fan blade device 2 of the present disclosure is illustrated. The second embodiment is substantially the same as the first embodiment, except that: the second embodiment further includes a first annular outer frame 71 surrounding and connected to the main fan blades 5, a second annular outer frame 72 disposed under the first annular outer frame 71 and surrounding and connected to the extension fan blades 6, and a plurality of clip fasteners 73 extending upward from the second annular outer frame 72 and clamping on the first annular outer frame 71. The first raised edge sections 54 and the second raised edge sections 64 mentioned in the previous embodiment are omitted in the second embodiment. The clip fasteners 73 may be applied to clip the first annular outer frame 71 as mentioned above to secure the first annular outer frame 71 on the second annular outer frame 72, or they may be applied to abut against the first annular outer frame 71 for positioning the first annular outer frame 71 relative to the second annular outer frame 72. The second embodiment can be mounted to a base frame B, as shown in FIG. 9, to enhance versatility.

In summary, the present disclosure can improve the connection strength between the main fan blades 5 and the extension fan blades 6, and have better stability during operation. At the same time, it can suppress noise generation via the bulges formed by the first protrusions 52 and the second protrusions 62.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A fan blade device comprising:

an upper hub member having an outer surrounding surface surrounding an axis extending in an axial direction;

a lower hub member coupled to and disposed under said upper hub member, and having an external surrounding surface that surrounds the axis;

a plurality of main fan blades extending outward from said outer surrounding surface of said upper hub member; and a plurality of extension fan blades extending outward from said external surrounding surface of said lower hub member and respectively abutting against said main fan blades;

wherein each main fan blade includes a main fan blade body that is arranged obliquely with respect to the axis, a plurality of first protrusions that protrude from said main fan blade body, and at least one engaging groove that is recessed in a bottom surface of said main fan blade body; and wherein each extension fan blade includes an extension fan blade body that is arranged obliquely with respect to the axis and that has a top surface being contiguously flush with a top surface of said main fan blade body of the respective one of said main fan blades, a plurality of second protrusions that protrude from said extension fan blade body and that respectively abut against said first protrusions of the respective one of said main fan blades, and at least one engaging piece that protrudes upward from said extension fan blade body and that engages said at least one engaging groove of the respective one of said main fan blades.

2. The fan blade device as claimed in claim 1, wherein:

said upper hub member includes a top wall, an upper inner annular wall extending downward from a bottom surface of said top wall, and an upper outer annular wall extending downward from said bottom surface of said top wall, surrounding and spaced apart from said upper inner annular wall, and having said outer surrounding surface; and said lower hub member includes a lower inner annular wall disposed under and abutting against said upper inner annular wall of said upper hub member, a lower outer annular wall surrounding said lower inner annular wall, disposed under and abutting against said upper outer annular wall of said upper hub member, and having said external surrounding surface, and a plurality of lower strengthening ribs angularly spaced apart from each other, extending radially, and interconnecting said lower inner annular wall and said lower outer annular wall.

3. The fan blade device as claimed in claim 2, wherein:

said upper outer annular wall of said upper hub member further has an inner surrounding surface opposite to said outer surrounding surface and surrounding the axis;

said lower outer annular wall of said lower hub member further has an internal surrounding surface opposite to said external surrounding surface and surrounding the axis; and said lower hub member further includes a plurality of positioning pieces that extend upward from said internal surrounding surface of said lower outer annular wall into said upper hub member between said upper outer annular wall and said upper inner annular wall, and engaging said inner surrounding surface of said upper outer annular wall of said upper hub member.

4. The fan blade device as claimed in claim 2, wherein:

said upper outer annular wall of said upper hub member further has a bottom surface in contact with said lower outer annular wall of said lower hub member, and at least one indentation formed in said bottom surface; and said lower hub member further includes at least one positioning block protruding upward from said lower outer annular wall and engaging said at least one indentation, respectively.

5. The fan blade device as claimed in claim 2, wherein said upper hub member further includes a plurality of upper strengthening ribs angularly spaced apart from each other, extending radially, and interconnecting said upper inner annular wall and said upper outer annular wall.

6. The fan blade device as claimed in claim 1, wherein:

each main fan blade further includes a first raised edge section protruding upward from said top surface of said main fan blade body and extending in a circumferential direction; and each extension fan blade further includes a second raised edge section protruding upward from said top surface of said extension fan blade body, extending in the circumferential direction, and is contiguously flush with said first raised edge section of the respective main fan blade.

7. The fan blade device as claimed in claim 1, further comprising a first annular outer frame surrounding and connected to said plurality of main fan blades, and a second annular outer frame surrounding and connected to said extension fan blades and disposed under said first annular outer frame.

8. The fan blade device as claimed in claim 7, further comprising a plurality of clip fasteners extending upward from said second annular outer frame and clamping on said first annular outer frame.

9. The fan blade device as claimed in claim 1, wherein each of said main fan blades partially overlaps an adjacent one of said extension fan blades in the axial direction.

* * * * *